US007005986B2

(12) United States Patent
Parks, III et al.

(10) Patent No.: US 7,005,986 B2
(45) Date of Patent: Feb. 28, 2006

(54) REMOTE TEMPERATURE MONITORING APPARATUS

(75) Inventors: William L. Parks, III, Germantown, MD (US); William L. Grenoble, Accokeek, MD (US); Clifford Harwood, Kalamazoo, MI (US); William R. Tarello, Havre de Grace, MD (US)

(73) Assignee: Kardios Corporation, Gaithersburg, MD (US)

( * ) Notice: Subject to any disclaimer, the term of this patent is extended or adjusted under 35 U.S.C. 154(b) by 141 days.

(21) Appl. No.: 10/642,675

(22) Filed: Aug. 19, 2003

(65) Prior Publication Data

US 2005/0040945 A1 Feb. 24, 2005

(51) Int. Cl.
*G08B 13/14* (2006.01)

(52) U.S. Cl. ..... 340/572.1; 128/903; 600/309

(58) Field of Classification Search ..... 340/572.1; 128/903; 600/309
See application file for complete search history.

(56) References Cited

U.S. PATENT DOCUMENTS 3,659,204 A * 4/1972 Hufford ..... 455/281
3,810,147 A * 5/1974 Lichtblau ..... 340/572.3
4,070,670 A 1/1978 Chen
4,437,773 A 3/1984 Dinger et al.
4,775,913 A 10/1988 Ekblad
4,782,420 A 11/1988 Holdgaard-Jensen
4,844,076 A * 7/1989 Lesho et al. ..... 600/302
5,079,407 A 1/1992 Baker
5,204,681 A 4/1993 Greene
5,291,205 A 3/1994 Greene
5,378,482 A 1/1995 Kersten et al.
5,489,764 A 2/1996 Mannuss et al.
5,686,779 A 11/1997 Vig
5,719,586 A 2/1998 Tuttle
5,746,114 A 5/1998 Harris
5,796,346 A 8/1998 Wash et al.
5,891,240 A 4/1999 Greene
5,945,017 A 8/1999 Cheng et al.

(Continued)

*Primary Examiner*—Daniel Wu
*Assistant Examiner*—Samuel J. Walk
(74) *Attorney, Agent, or Firm*—Marvin S. Towsend

(57) ABSTRACT

A remote temperature monitoring apparatus includes a base-located energizing wave transmission/communication wave reception unit (e.g. located on a cooking stove) and a remotely-located, energizing-wave-powered, temperature-dependent communication wave emission unit (e. g. located on a cooking vessel). The base-located energizing wave transmission/communication wave reception unit transmits a series of probing energizing waves and receives temperature-dependent resonant communication wave emissions. The remotely-located, energizing-wave-powered, temperature-dependent communication wave emission unit includes material which has a temperature-dependent communication wave emission characteristic, monitors temperature at the remote location, and transmits a temperature-dependent resonant communication wave emission which is received by the base-located energizing wave transmission/communication wave reception unit which provides an alarm signal when the monitored temperature at the remote location (the cooking vessel) is equal to or is beyond a predetermined alarm temperature.

31 Claims, 4 Drawing Sheets

U.S. PATENT DOCUMENTS 5,951,900 A * 9/1999 Smrke ..... 219/497
5,995,898 A * 11/1999 Tuttle ..... 701/102
6,032,663 A 3/2000 Pencheon
6,057,529 A 5/2000 Kirby
6,059,733 A * 5/2000 Brune et al. ..... 600/549
6,069,564 A 5/2000 Hatano et al.
6,097,347 A 8/2000 Duan et al.
6,104,007 A 8/2000 Lerner
6,104,311 A * 8/2000 Lastinger ..... 340/10.51
6,118,104 A 9/2000 Berkcan et al.
6,130,413 A 10/2000 Rak
6,130,602 A * 10/2000 O'Toole et al. ..... 340/10.33
6,130,612 A 10/2000 Castellano et al.
6,166,706 A 12/2000 Gallagher, III et al.
6,236,025 B1 5/2001 Berkcan et al.
6,238,354 B1 5/2001 Alvarez
6,278,369 B1 8/2001 Smith et al.
6,285,342 B1 9/2001 Brady et al.
6,313,747 B1 11/2001 Imaichi et al.
6,320,169 B1 11/2001 Clothier
6,359,444 B1 3/2002 Grimes
6,377,176 B1 4/2002 Lee
6,632,175 B1 * 10/2003 Marshall ..... 600/309
6,646,567 B1 * 11/2003 Olivas ..... 340/870.17
2001/0045899 A1 * 11/2001 Hoek ..... 340/870.28

* cited by examiner

REMOTE TEMPERATURE MONITORING APPARATUS

CROSS-REFERENCE TO RELATED APPLICATIONS

This application claims priority based upon abandoned United States Provisional Application entitled COOK STOVE SAFETY APPARATUS, Filing Date Apr. 30, 2002, Ser. No. 60/376,231 and upon abandoned U.S. Provisional Application entitled REMOTE TEMPERATURE MONITORING APPARATUS, Filing Date Jul. 2, 2002, Ser. No. 60/392,977.

FIELD OF THE INVENTION

The present invention relates generally to remote temperature monitoring apparatuses such as used in heating devices, cooling devices, medical devices, automotive applications, aircraft applications, exceeding desired temperature monitoring, and temperature testing environments. More specifically, the present invention relates to safety devices especially adapted for preventing fires on cook stoves.

DESCRIPTION OF THE PRIOR ART

The November 2000 issue of Good Housekeeping magazine reports that some 75,000 stove related kitchen fires occurred in the United States during 1990. These fires resulted in 250 people being killed. Most people who use a kitchen range have at one time or another had a situation occur that is an unsafe overheating situation and could result in a fire if left uncorrected. The most common overheating situations occur from forgetting to turn off the range after finishing cooking and from allowing the cooking liquid to boil off. Both situations allow the cooking temperature to rise to a point that the food being cooked can catch on fire. There are many more unsafe situations that arise, but the two described serve to illustrate a significant point. That is, it would be desirable if an apparatus were provided that detects, warns, and if necessary corrects dangerous stove overheating situations.

Traditional approaches to monitoring temperature include classic thermocouples and infrared detectors. Each of these approaches has serious drawbacks that make them impractical for a stove top environment. For example, the thermocouple approach requires that wires be placed on the range top. Obviously, this is not very desirable or practical. Similarly, infrared has the drawback that although it does not require wires, it measures the vessel temperature by detecting the IR rays emitted from the cooking vessel. This is very difficult to do with vessels that have low IR emissivity such as those made of shiny metal such as aluminum and stainless steel. In this respect, most kitchen cooking vessels are made of aluminum or stainless steel, and many cooks pride themselves on keeping their cookware shiny and clean. Accordingly, it would be desirable if a novel and unique method to measure the vessel temperature were provided which can be used with aluminum and stainless steel cookware.

In addition to the above discussion, a number of patents are listed and discussed below. Generally, these patents relate to the arts of monitoring apparatuses and conditions, and in taking actions based on the monitored apparatuses and conditions.

| | |
|---|---|
| 4,070,670 | Chen |
| 4,437,773 | Dinger et al |
| 4,775,913 | Ekblad |
| 4,782,420 | Holdgaard-Jensen |
| 5,079,407 | Baker |
| 5,204,681 | Greene |
| 5,291,205 | Greene |
| 5,378,482 | Kersten et al |
| 5,489,764 | Mannuss et al |
| 5,686,779 | Vig |
| 5,719,586 | Tuttle |
| 5,746,114 | Harris |
| 5,891,240 | Greene |
| 5,796,346 | Wash et al |
| 5,945,017 | Cheng et al |
| 6,032,663 | Pencheon |
| 6,057,529 | Kirby |
| 6,069,564 | Hatano et al |
| 6,097,347 | Duan et al |
| 6,104,007 | Lerner |
| 6,118,104 | Berkcan et al |
| 6,130,413 | Rak |
| 6,130,612 | Castellano et al |
| 6,166,706 | Gallagher et al |
| 6,236,025 | Berkcan et al |
| 6,238,354 | Alvarez |
| 6,278,369 | Smith et al |
| 6,285,342 | Brady et al |
| 6,313,747 | Imaichi et al |
| 6,320,169 | Clothier |
| 6,359,444 | Grimes |
| 6,377,176 | Lee |

Of the patents listed above, the following disclose devices relating to monitoring conditions of a heat source.

Chen (U.S. Pat. No. 4,070,670) discloses an automatic shut-off and alarm for a stove heating unit. A water drop detector detects a water overflow, causing an automatic fuel cut off to the burner.

Ekblad (U.S. Pat. No. 4,775,913) discloses a safety shut-off device for a stove. When a person is sensed by sensor 10 (sensing heat emitted by the person) to be in the vicinity of the stove, the stove can be turned on. When the presence of the person is not sensed, the stove turns off.

Holdgaard-Jensen (U.S. Pat. No. 4,782,420) discloses a safety switch apparatus that shuts off power to a stove after a pre-set time has expired.

Baker (U.S. Pat. No. 5,079,407) discloses a boil condition detection device for a range. When moisture is detected from a boiling condition, a directly connected electrical circuit activates an alarm and/or shuts off electrical power to a heating element.

Kersten et al (U.S. Pat. No. 5,378,482) disclose a method of controlling the boiling power for a water-containing vessel that employs directly monitoring the amount of water evaporating at atmospheric pressure.

Mannuss et al (U.S. Pat. No. 5,489,764) disclose a radiant heating unit that employs a temperature sensor that is directly connected to control elements for controlling power to the radiant heating unit.

Vig (U.S. Pat. No. 5,686,779) discloses a temperature sensor and sensor array that employs thermometer cut quartz microresonators that are exposed to a radiant energy source. The microresonators are directly energized by a directly connected electrical source. Absorbed radiation from a radiant image changes temperature dependent frequencies in the sensor array. Each microresonator is thermally isolated from its environment.

Harris (U.S. Pat. No. 5,746,114) discloses an intelligent cooking system with wireless control. Battery-powered transceiver modules 54 can be placed on cooking implements and, preferably, emit temperature and identifying information in the form of communication signals to a controller unit. The temperature information is based upon a temperature sensor which may be of the thermistor or resistive type. It is noted that when battery-powered transceiver modules are employed, the transceiver modules can fail to operate if battery power is drained. In this respect, it would be desirable if a remote temperature monitoring apparatus were provided which does not employ battery-powered transceiver modules placed on cooking implements. Moreover, it is also noted that when a thermistor or resistive type temperature sensor is employed in a transceiver module, the transceiver module must also include transmitter circuitry which responds to changes in the temperature-sensitive thermistor or resistor. To avoid the complexities associated with a thermistor or resistive type temperature sensor and transmitter circuitry which is responsive to the thermistor or resistive type temperature sensor, it would be desirable if a remote temperature monitoring apparatus were provided which includes, in general, a material having a temperature-dependent communication wave emission characteristic or, more specifically, a material having a temperature-dependent, radio frequency electromagnetic wave emission frequency characteristic. In this way, the complexities associated with a thermistor or resistive type temperature sensor and associated transmitter circuitry would be avoided.

Wash et al (U.S. Pat. No. 5,796,346) disclose a stove that has built-in grease fire avoidance circuitry which depends upon predetermined temperature settings of temperature sensors built into the stove. When a predetermined temperature is reached at a burner, a switch disengages the burner.

Cheng et al (U.S. Pat. No. 5,945,017) disclose a fire safety device for a stove top burner. A built-in motion sensor detects the proximity of a person. If the person is not detected for a predetermined period of time, power to the burner is turned off. A built-in temperature sensor will also turn off the burner if a predetermined temperature is reached.

Pencheon (U.S. Pat. No. 6,032,663) discloses a stove emergency cutoff system that includes a built-in flame sensing facility 32 and that cuts off power when flame is detected.

Kirby (U.S. Pat. No. 6,057,529) discloses a built-in combination temperature sensor, warning light sensor, and light indicator for heating elements.

Lerner (U.S. Pat. No. 6,104,007) discloses a built-in heat alert safety device for stoves and related appliances. Liquid crystals display the word "HOT" when a burner is hot.

Berkcan et al (U.S. Pat. Nos. 6,118,104 and 6,236,025) disclose a built-in acoustic signal sensing device which detects different acoustic signals given off by pre-boil, boil, boil dry, and boil over states, among others.

Rak (U.S. Pat. No. 6,130,413) discloses a built-in safety device for an electric cooking stove. The device includes a proximity detector for detecting the proximity of a person attending the stove. When a person is not detected, a timer begins to run. When a prescribed period of time expires, the stove is turned off.

Alvarez (U.S. Pat. No. 6,238,354) discloses a wrist-worn temperature monitoring assembly that includes a built-in temperature sensor.

Clothier (U.S. Pat. No. 6,320,169) discloses a temperature-regulating induction heating system using a radio frequency identification tag on a heated object which retains information about the heated object. The retained information is transmitted to the induction heating system. On the radio frequency identification tag, a temperature-dependent switch may be provided to turn on, to turn off, or to alter transmission from the radio frequency identification tag, based upon temperatures experienced by the temperature-dependent switch. There is no disclosure of a material having a temperature-dependent communication wave emission characteristic or a material having a temperature-dependent, radio frequency electromagnetic wave emission frequency characteristic.

The following patents listed above disclose either temperature measurement systems or object identification systems.

Dinger et al (U.S. Pat. No. 4,437,773) disclose a quartz thermometer which is powered directly by electrical current with from a direct connection to an electrical power source and which is directly connected to an electronic circuit which produces an output representative of temperature.

Greene (U.S. Pat. Nos. 5,204,681, 5,291,205, and 5,891,240) discloses a radio frequency automatic identification system which employs a base-located energizing wave transmission/communication wave reception unit and a plurality of remotely-located, energizing-wave-powered, wave emission target units. Each remotely-located wave emission target unit has its own distinctive set of identifying wave emission frequencies. No temperature changes or temperature-dependent changed frequencies are disclosed.

Tuttle (U.S. Pat. No. 5,719,586) discloses antenna patterns arranged in a two-dimensional plane for use in radio frequency identification systems.

Hatano et al (U.S. Pat. No. 6,069,564) disclose a multi-directional radio frequency automatic identification system read/write antenna. No temperature measurements are disclosed.

Duan et al (U.S. Pat. No. 6,097,347) disclose a wire antenna with stubs to optimize impedance for connecting to a circuit. No temperature measurements are disclosed.

Castellano et al (U.S. Pat. No. 6,130,612) disclose a radio frequency identification transponder tag for use in a radio frequency automatic identification system. No temperature measurements are disclosed.

Gallagher et al (U.S. Pat. No. 6,166,706) disclose a rotating field antenna with a magnetically coupled quadrature loop. The antenna is used with tags in radio frequency automatic identification systems. The tags resonate at 13.56 MHz.

Smith et al (U.S. Pat. No. 6,278,369) disclose methods for tagging an object having a conductive surface. No temperature measurements are disclosed.

Brady et al (U.S. Pat. No. 6,285,342) disclose a radio frequency tag with a miniaturized resonant antenna. No temperature measurements are disclosed.

Imaichi et al (U.S. Pat. No. 6,313,747) disclose a resonant tag. No temperature measurements are disclosed.

Lee (U.S. Pat. No. 6,377,176) discloses a metal compensated radio frequency identification reader. No temperature measurements are disclosed.

Also, listed above is the Grimes (U.S. Pat. No. 6,359,444) patent which discloses a remote, resonant-circuit sensing apparatus that measures characteristics of a chemical analyte. The sensor can be responsive to a thermal response to the analyte. A thermally-sensitive material can be in the form of a thin outer layer that is bonded or adhered to one of the components of the resonant circuit or to the antenna. The thermally-sensitive material can volumetrically expand in response to a temperature change. There is no disclosure of measuring ambient temperature in the absence of a chemical analyte and in the absence of a sensor for the chemical analyte. Also, there is no disclosure of a material having a temperature-dependent communication wave emission characteristic or of a material having a temperature-dependent, radio frequency electromagnetic wave emission frequency characteristic.

In general, there are a wide range of environments in which a remote temperature monitoring apparatus can be employed for monitoring, at a base location, the temperature of a remotely-located object. Moreover, with such a wide variety of environments, it would be desirable to provide an alarm signal if the monitored temperature is outside of an acceptable range.

For purposes of simplicity and practicality in a remote temperature monitoring apparatus, it would be desirable if a communication link between a base location and a remote location be wireless. With a wireless link, problems associated with wires (such as snagging, shorting, tangling, and burning) are avoided.

In the environment of a heating device, it would be desirable if a remote temperature monitoring apparatus can be employed for monitoring, at the heating device, the temperature of a remotely-located heated vessel, and for providing an alarm signal if the monitored temperature is outside of an acceptable range.

More specifically, in the environment of a cooking stove, it would be desirable if a remote temperature monitoring apparatus can be employed for monitoring, at the cooking stove, the temperature of a cooking vessel heated on the stove, and for providing an alarm signal if the monitored temperature of the cooking vessel is outside of an acceptable range.

In a medical environment, it would be desirable if a remote temperature monitoring apparatus can be employed for monitoring, at a base location, such as outside a patient, the temperature at a remote location, such as inside a patient, and for providing an alarm signal if the monitored temperature is outside of an acceptable range. In this respect, it would be desirable if the location inside the patient could be monitored by a "pill" type device that is swallowed by the patient for monitoring the core temperature of the patient and for causing an alarm signal if the core temperature of the patient is outside of an acceptable range.

Also, in a medical environment, it would be desirable if a remote temperature monitoring apparatus can be employed for monitoring, at a base location, such as outside a patient in an operating room, the temperature at a remote location, such as inside a patient undergoing an operation for monitoring the temperature of the lavage fluids used in the operation and pooled in a body cavity and for causing an alarm signal to be emitted if the monitored temperature of the lavage fluids used in the operation is outside of an acceptable range.

In the environment of a cooling device, such as a "slush" bag containing a mixture of water and ice, that is used for preserving organs to be transplanted, it would be desirable if a remote temperature monitoring apparatus could have a portion located at a location outside the "slush" bag, and could have another portion located at a remote location, such as inside the "slush" bag, for monitoring the temperature of the "slush" and preserved organs, and for causing an alarm signal to be emitted if the monitored temperature of the "slush" and preserved organs is outside of an acceptable range.

In an automotive environment, it would be desirable if a remote temperature monitoring apparatus could have a portion located at a base location, such as in a passenger compartment of a vehicle, and could have another portion located at a remote location, such as on a brake component, for monitoring the temperature of the brake component and for causing the an alarm signal to be emitted if the monitored temperature of the brake component is outside of an acceptable range.

Also, in an automotive environment, it would be desirable if a remote temperature monitoring apparatus could have a portion located at a base location, such as in a passenger compartment of a vehicle, and could have another portion located at a remote location, such as on a catalytic converter, for monitoring the temperature of the catalytic converter and for causing the an alarm signal to be emitted if the monitored temperature of the catalytic converter is outside of an acceptable range.

In an aircraft environment, it would be desirable if a remote temperature monitoring apparatus could have a portion located at a base location, such as inside an airplane cockpit, and could have another portion located at a remote location, such as on an engine tailpipe for monitoring the temperature of the engine tailpipe and for causing an alarm signal to be emitted if the monitored temperature of the engine tailpipe is outside of an acceptable range.

Thus, while the foregoing body of prior art indicates it to be well known to use remote temperature monitoring apparatuses, the prior art described above does not teach or suggest a remote temperature monitoring apparatus which has the following combination of desirable features: (1) can detect, warn, and if necessary correct dangerous overheating situations; (2) provides a wireless communication link between a base location and a remote location; (3) in the environment of a heating device, monitors at the heating device, the temperature of a remotely-located heated vessel, and provides an alarm signal if the monitored temperature is outside of an acceptable range; (4) in the environment of a cooking stove, monitors, at the cooking stove, the temperature of a cooking vessel heated on the stove, and provides an alarm signal if the monitored temperature of the cooking vessel is outside of an acceptable range; (5) in a medical environment, monitors, at a base location, such as outside a patient, the temperature at a remote location, such as inside a patient, and provides an alarm signal if the monitored temperature is outside of an acceptable range; (6) in a medical environment, provides that the location inside the patient can be monitored by a "pill" type device that is swallowed by the patient for monitoring the core temperature of the patient and for causing an alarm signal, at a base location, if the core temperature of the patient is outside of an acceptable range; (7) in a medical environment, monitors, at a base location, such as outside a patient in an operating room, the temperature at a remote location, such as inside a patient undergoing an operation for monitoring the temperature of the lavage fluids used in the operation and pooled in a body cavity and for causing an alarm signal to be emitted if the monitored temperature of the lavage fluids used in the operation is outside of an acceptable range; (8) in the environment of a cooling device, such as a "slush" bag containing a mixture of water and ice, that is used for preserving organs to be transplanted, can have a portion located at a base location outside the "slush" bag, and can have another portion located at a remote location, such as inside the "slush" bag, for monitoring the temperature of the "slush" and preserved organs, and for causing an alarm signal to be emitted if the monitored temperature of the "slush" and preserved organs is outside of an acceptable range; (9) in an automotive environment, can have a portion located at a base location, such as in a passenger compartment of a vehicle, and can have another portion located at a remote location, such as on a brake component, for monitoring the temperature of the brake component and for causing the an alarm signal to be emitted if the monitored temperature of the brake component is outside of an acceptable range; (10) in an aircraft environment, can have a-portion-located at a base location, such as inside an airplane cockpit, and can have another portion located at a remote location,-such as on an engine tailpipe for monitoring the temperature of the engine tailpipe and for causing an alarm signal to be emitted if the monitored temperature of the engine tailpipe is outside of an acceptable range; (11) does not employ battery-powered transceiver modules placed on cooking implements; and (12) includes, in general, a material having a temperature-dependent communication wave emission characteristic or, more specifically, a material having a temperature-dependent, radio frequency electromagnetic wave emission frequency characteristic.

The foregoing desired characteristics are provided by the unique remote temperature monitoring apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a remote temperature monitoring apparatus which includes a base-located energizing wave transmission/communication wave reception unit located at a base location and a remotely-located, energizing-wave-powered, temperature-dependent communication wave emission unit, located a remote location from the base location. The base-located energizing wave transmission/communication wave reception unit transmits an energizing wave and receives temperature-dependent communication wave emissions. The remotely-located, energizing-wave-powered, temperature-dependent communication wave emission unit monitors temperature at the remote location and transmits a temperature-dependent communication wave emission. The remotely-located, energizing-wave-powered, temperature-dependent communication wave emission unit includes material which has a temperature-dependent communication wave emission characteristic. The temperature-dependent communication wave emission is received by the base-located energizing wave transmission/communication wave reception unit which provides an alarm signal when the monitored temperature at the remote location is equal to or is beyond a predetermined alarm temperature. The alarm signal can be an audible alarm signal and/or a visible alarm signal.

Preferably, the base-located energizing wave transmission/communication wave reception unit provides the alarm signal at the base location.

With one class of embodiments of the invention, the remotely-located, energizing-wave-powered, temperature-dependent communication wave emission unit is located at a vessel that is heated by a heating device and is used for monitoring the temperature of the vessel being heated. In this respect, the base-located energizing wave transmission/communication wave reception unit is located at a location away from the vessel being heated and provides an alarm signal when the monitored temperature of the vessel being heated is equal to or is beyond a predetermined alarm temperature.

With another class of embodiments of the invention, the remotely-located, energizing-wave-powered, temperature-dependent communication wave emission unit is in a pill-like form and is used for monitoring the core temperature of the patient. In this respect, the base-located energizing wave transmission/communication wave reception unit provides an alarm signal when the monitored core temperature of the patient is equal to or is beyond a predetermined alarm temperature.

With another class of embodiments of the invention, the remotely-located, energizing-wave-powered, temperature-dependent communication wave emission unit is located inside a patient undergoing an operation and is used for monitoring the temperature of lavage fluids used in the operation and pooled in a body cavity. With such an embodiment, the base-located energizing wave transmission/communication wave reception unit is located outside the patient and provides an alarm signal when the monitored temperature of the lavage fluids used in the operation and pooled in a body cavity is equal to or is beyond a predetermined alarm temperature.

With another class of embodiments of the invention, the remotely-located, energizing-wave-powered, temperature-dependent communication wave emission unit is located inside a cooling device and is used for monitoring the temperature inside the cooling device. In this respect, the base-located energizing wave transmission/communication wave reception unit is located outside the cooling device and provides an alarm signal when the monitored temperature inside the cooling device is equal to or is beyond a predetermined alarm temperature. The cooling device can be a slush bag for holding preserved organs.

With another class of embodiments of the invention, the remotely-located, energizing-wave-powered, temperature-dependent communication wave emission unit is located at an automotive component outside a passenger compartment and is used for monitoring the temperature of the automotive component. In this respect, the base-located energizing wave transmission/communication wave reception unit is located inside the passenger compartment and provides an alarm signal when the monitored temperature of the automotive component outside the passenger compartment is equal to or is beyond a predetermined alarm temperature.

More specifically with respect to an automotive embodiment, the remotely-located, energizing-wave-powered, temperature-dependent communication wave emission unit can be located at a brake component, and the base-located energizing wave transmission/communication wave reception unit, in the passenger compartment, provides an alarm signal when the monitored temperature of the brake component is equal to or is beyond a predetermined alarm temperature.

Also, with respect to another automotive embodiment, the remotely-located, energizing-wave-powered, temperature-dependent communication wave emission unit can be located at a catalytic converter, and the base-located energizing wave transmission/communication wave reception unit, in the passenger compartment, provides an alarm signal when the monitored temperature of the catalytic converter is equal to or is beyond a predetermined alarm temperature.

With another class of embodiments of the invention, the remotely-located, energizing-wave-powered, temperature-dependent communication wave emission unit is located at an aircraft component outside a cockpit and is used for monitoring the temperature of the aircraft component. In this respect, the base-located energizing wave transmission/communication wave reception unit is located inside the cockpit and provides an alarm signal when the monitored temperature of the aircraft component outside the cockpit is equal to or is beyond a predetermined alarm temperature.

With another aircraft embodiment, the remotely-located, energizing-wave-powered, temperature-dependent communication wave emission unit can be located at an engine tailpipe, and the base-located energizing wave transmission/communication wave reception unit provides an alarm signal when the monitored temperature of the an engine tailpipe is equal to or is beyond a predetermined alarm temperature.

Preferably, the energizing wave and the temperature-dependent communication wave emission are electromagnetic waves. More preferably, the energizing wave and the temperature-dependent communication wave emission are radio frequency electromagnetic waves.

Preferably, the remotely-located, energizing-wave-powered, temperature-dependent communication wave emission unit includes a resonating wave emitter. In this respect, the base-located energizing wave transmission/communication wave reception unit includes a reader/interrogator, and the remotely-located, energizing-wave-powered, temperature-dependent communication wave emission unit includes a tag/transponder which includes the material which has a temperature-dependent communication wave emission characteristic.

Preferably, the reader/interrogator includes a transmitter portion and a receiver portion which respectively transmits and receives communication wave emissions in a frequency range that has a predetermined nominal wave frequency. Also, the material which has a temperature-dependent communication wave emission characteristic in the tag/transponder is combined with an antenna providing a receiver/transmitter which respectively receives and transmits communication wave emissions in a frequency range which includes the predetermined nominal wave frequency. The communication wave emissions transmitted by the tag/transponder vary in accordance with the temperature of the material which has a temperature-dependent communication wave emission characteristic.

Preferably, the reader/interrogator includes a transmitter portion and a receiver portion which respectively transmits and receives radio frequency electromagnetic waves in a frequency range which has a predetermined nominal radio frequency, and the material which has a temperature-dependent communication wave emission characteristic in the tag/transponder includes a crystal-based receiver/transmitter which respectively receives and transmits radio frequency electromagnetic waves in a frequency range which includes the predetermined nominal radio frequency. The frequency of the radio frequency electromagnetic waves transmitted by the tag/transponder varies in accordance with the temperature of the temperature-dependent communication wave emission material in the crystal-based receiver/transmitter.

With one preferred embodiment, the reader/interrogator includes a transmitter portion and a receiver portion which respectively transmits and receives radio frequency electromagnetic waves in a frequency range which has a nominal radio frequency of 27.12 MHz. Similarly, the material which has a temperature-dependent communication wave emission characteristic in the tag/transponder includes a crystal-based receiver/transmitter which respectively receives and transmits radio frequency electromagnetic waves in a frequency range which has a nominal radio frequency of 27.12 MHz. The frequency of the electromagnetic waves transmitted by the tag/transponder varies in accordance with the temperature of temperature-dependent communication wave emission material in the crystal-based receiver/transmitter.

Preferably, the crystal-based receiver/transmitter includes a quartz crystal. The crystal-based receiver/transmitter includes an antenna which is connected to the quartz crystal.

With another preferred embodiment, the reader/interrogator includes a transmitter portion and a receiver portion which respectively transmits and receives radio frequency electromagnetic waves in a frequency range which has a nominal radio frequency of 13.56 MHz. Similarly, the material which has a temperature-dependent communication wave emission characteristic in the tag/transponder includes a crystal-based receiver/transmitter which respectively receives and transmits radio frequency electromagnetic waves in a frequency range which has a nominal radio frequency of 13.56 MHz. The frequency of the radio frequency electromagnetic waves transmitted by the tag/transponder varies in accordance with the temperature of the temperature-dependent communication wave emission material in the crystal-based receiver/transmitter.

Preferably, the material which has a temperature-dependent communication wave emission characteristic has a range of temperature-dependent resonant frequencies corresponding to a range of monitored temperatures. In this respect, the base-located energizing wave transmission/communication wave reception unit transits a probing energizing wave which has a probing frequency. The remotely-located, energizing-wave-powered, temperature-dependent communication wave emission unit receives the probing energizing wave which has the probing frequency, and, when a temperature-dependent resonant frequency of the material which has a temperature-dependent communication wave emission characteristic substantially matches the probing frequency, the material which has a temperature-dependent communication wave emission characteristic emits a temperature-dependent resonant frequency which corresponds to a specific monitored temperature in the range of monitored temperatures.

The base-located energizing wave transmission/communication wave reception unit receives the temperature-dependent resonant frequency emitted from the remotely-located, energizing-wave-powered, temperature-dependent communication wave emission unit, which corresponds to the specific monitored temperature, and compares the specific monitored temperature to the predetermined alarm temperature.

More preferably, the base-located energizing wave transmission/communication wave reception unit transmits a series of probing energizing waves which have a series of probing frequencies. In this respect, the remotely-located, energizing-wave-powered, temperature-dependent communication wave emission unit receives the series of probing energizing waves which have the series of probing frequencies, and, when a temperature-dependent resonant frequency of the material which has a temperature-dependent communication wave emission characteristic substantially matches a specific probing frequency of the series of probing frequencies, the material which has a temperature-dependent communication wave emission characteristic emits a temperature-dependent resonant frequency which corresponds to a specific monitored temperature in the range of monitored temperatures.

The base-located energizing wave transmission/communication wave reception unit receives the temperature-dependent resonant frequency emitted from the remotely-located, energizing-wave-powered, temperature-dependent communication wave emission unit, which corresponds to the specific monitored temperature, and compares the specific monitored temperature to the predetermined alarm temperature.

The probing frequencies in the series of probing frequencies are separated from one another by a probing frequency interval, and the probing frequency interval is proportional to the ratio of the range of resonant frequencies to the range of monitored temperatures of the material which has a temperature-dependent communication wave emission characteristic.

In accordance with another aspect of the invention, a safety apparatus is provided for a heated object. The safety apparatus includes a reader/interrogator, remote from the heated object, which emits and receives radio frequency electromagnetic waves in a frequency range which has a predetermined nominal radio frequency. A tag/transponder is attached to the heated object. The tag/transponder includes a radio frequency electromagnetic wave emitter which includes a crystal material which has a temperature-dependent radio frequency electromagnetic wave emission characteristic in a frequency range having the predetermined nominal radio frequency. The tag/transponder receives radio frequency electromagnetic waves from the reader/interrogator and emits temperature-dependent radio frequency electromagnetic waves from the temperature-dependent radio frequency electromagnetic wave emitter. The temperature-dependent radio frequency electromagnetic waves are indicative of the temperature of the heated object, and the temperature-dependent radio frequency electromagnetic waves are received by the reader/interrogator. An alarm assembly, controlled by the reader/interrogator, provides an alarm signal when the reader/interrogator receives temperature-dependent radio frequency electromagnetic waves from the tag/transponder which indicate that a predetermined temperature has been reached by the heated object.

The heated object can be a cooking vessel, and the reader/interrogator can be located on a cook stove. In this respect, a safety apparatus is provided for a cook stove and includes a reader/interrogator which emits and receives communication waves. A tag/transponder is attached to a cooking vessel on the cook stove. Plural tag/transponders can be attached to plural cooking vessels. Each tag/transponder includes a temperature-dependent communication wave emitter which includes a material having a temperature-dependent communication wave emission characteristic. The tag/transponder receives communication waves from the reader/interrogator and emits temperature-dependent communication waves from the temperature-dependent communication wave emitter. The temperature-dependent communication waves are indicative of the temperature of the cooking vessel, and the temperature-dependent communication waves are received by the reader/interrogator. An alarm assembly, controlled by the reader/interrogator, provides an alarm signal when the reader/interrogator receives temperature-dependent communication waves from the tag/transponder which indicate that a predetermined temperature has been reached by the cooking vessel.

The apparatus of the invention works for both electric and gas ranges. The apparatus is designed for use with existing ranges and does not require modifications to existing ranges. The apparatus can also be designed to automatically shut off the electricity or gas when an unsafe condition has been detected and not corrected after a predetermined period of time.

The invention provides the ability to measure the temperature of each cooking vessel and also provides the ability to detect when there is no cooking vessel present and the burner is on. This information can be processed by an on-board microprocessor that supplies the necessary intelligence to generate the appropriate action based on the data collected.

The present invention could be implemented in many ways. Once the principles of the present invention are understood, a person with ordinary skill in the present art can design a system to accomplish the functions of the present invention. This disclosure does not describe all of the multitude of possible ways to accomplish actual applications in accordance with the principles of the invention.

In accordance with another aspect of the invention, a crystal-based receiver/transmitter apparatus includes a crystal, and an antenna is connected to the crystal. The crystal is a quartz crystal, and the quartz crystal receives and transmits radio frequency electromagnetic waves in a frequency range which has a nominal radio frequency of 27.12 MHz. Alternatively, the crystal is a quartz crystal, and the quartz crystal receives and transmits radio frequency electromagnetic waves in a frequency range which has a nominal radio frequency of 13.56 MHz.

In accordance with another aspect of the invention, a method is provided for monitoring temperature of a remote location at a base location, wherein the method includes the steps of:

emitting base-emitted energizing waves from a transmitter at the base location;

receiving the base-emitted energizing waves at the remote location, whereby the base-emitted energizing waves energize a temperature-dependent transmitter at the remote location, wherein the temperature-dependent transmitter at the remote location includes a quantity of material having a temperature-dependent communication wave emission characteristic;

emitting remote-location-emitted, temperature-dependent communication waves from the temperature-dependent transmitter at the remote location, wherein the remote-location-emitted, temperature-dependent communication waves represent a temperature measurement at the remote location, based upon the temperature of the material having a temperature-dependent communication wave emission characteristic;

receiving the remote-location-emitted, temperature-dependent communication waves at the base location;

comparing the temperature measurement at the remote location with a predetermined alarm temperature; and providing an alarm signal if the temperature measurement at the remote location is equal to or greater than the predetermined alarm temperature.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention to provide a remote temperature monitoring apparatus which can detect, warn, and if necessary correct dangerous stove overheating situations.

Still another object of the present invention is to provide a remote temperature monitoring apparatus that provides a wireless communication link between a base location and a remote location.

Yet another object of the present invention is to provide a remote temperature monitoring apparatus which, in the environment of a heating device, monitors at the heating device, the temperature of a remotely-located heated vessel, and provides an alarm signal if the monitored temperature is outside of an acceptable range.

Even another object of the present invention is to provide a remote temperature monitoring apparatus that, in the environment of a cooking stove, monitors, at the cooking stove, the temperature of a cooking vessel heated on the stove, and provides an alarm signal if the monitored temperature of the cooking vessel is outside of an acceptable range.

Still a further object of the present invention is to provide a remote temperature monitoring apparatus which, in a medical environment, monitors, at a base location, such as outside a patient, the temperature at a remote location, such as inside a patient, and provides an alarm signal if the monitored temperature is outside of an acceptable range.

Yet another object of the present invention is to provide a remote temperature monitoring apparatus that, in a medical environment, provides that the location inside the patient can be monitored by a "pill" type device that is swallowed by the patient for monitoring the core temperature of the patient and for causing an alarm signal, at a base location, if the core temperature of the patient is outside of an acceptable range.

Still another object of the present invention is to provide a remote temperature monitoring apparatus which, in a medical environment, monitors, at a base location, such as outside a patient in an operating room, the temperature at a remote location, such as inside a patient undergoing an operation for monitoring the temperature of the lavage fluids used in the operation and pooled in a body cavity and for causing an alarm signal to be emitted if the monitored temperature of the lavage fluids used in the operation is outside of an acceptable range.

Yet another object of the present invention is to provide a remote temperature monitoring apparatus that, in the environment of a cooling device, such as a "slush" bag containing a mixture of water and ice, that is used for preserving organs to be transplanted, can have a portion located at a base location outside the "slush" bag, and can have another portion located at a remote location, such as inside the "slush" bag, for monitoring the temperature of the "slush" and preserved organs, and for causing an alarm signal to be emitted if the monitored temperature of the "slush" and preserved organs is outside of an acceptable range.

Still a further object of the present invention is to provide a remote temperature monitoring apparatus that, in an automotive environment, can have a portion located at a base location, such as in a passenger compartment of a vehicle, and can have another portion located at a remote location, such as on a brake component, for monitoring the temperature of the brake component and for causing the an alarm signal to be emitted if the monitored temperature of the brake component is outside of an acceptable range.

Yet another object of the present invention is to provide a remote temperature monitoring apparatus which, in an aircraft environment, can have a portion located at a base location, such as inside an airplane cockpit, and can have another portion located at a remote location, such as on an engine tailpipe for monitoring the temperature of the engine tailpipe and for causing an alarm signal to be emitted if the monitored temperature of the engine tailpipe is outside of an acceptable range.

Still a further object of the present invention is to provide a remote temperature monitoring apparatus that does not employ battery-powered transceiver modules placed on cooking implements.

Yet another object of the present invention is to provide a remote temperature monitoring apparatus which includes, in general, a material having a temperature-dependent communication wave emission characteristic or, more specifically, a material having a temperature-dependent, radio frequency electromagnetic wave emission frequency characteristic.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENTS

With reference to the drawings, a remote temperature monitoring apparatus embodying the principles and concepts of the present invention will be described.

Figure 1:
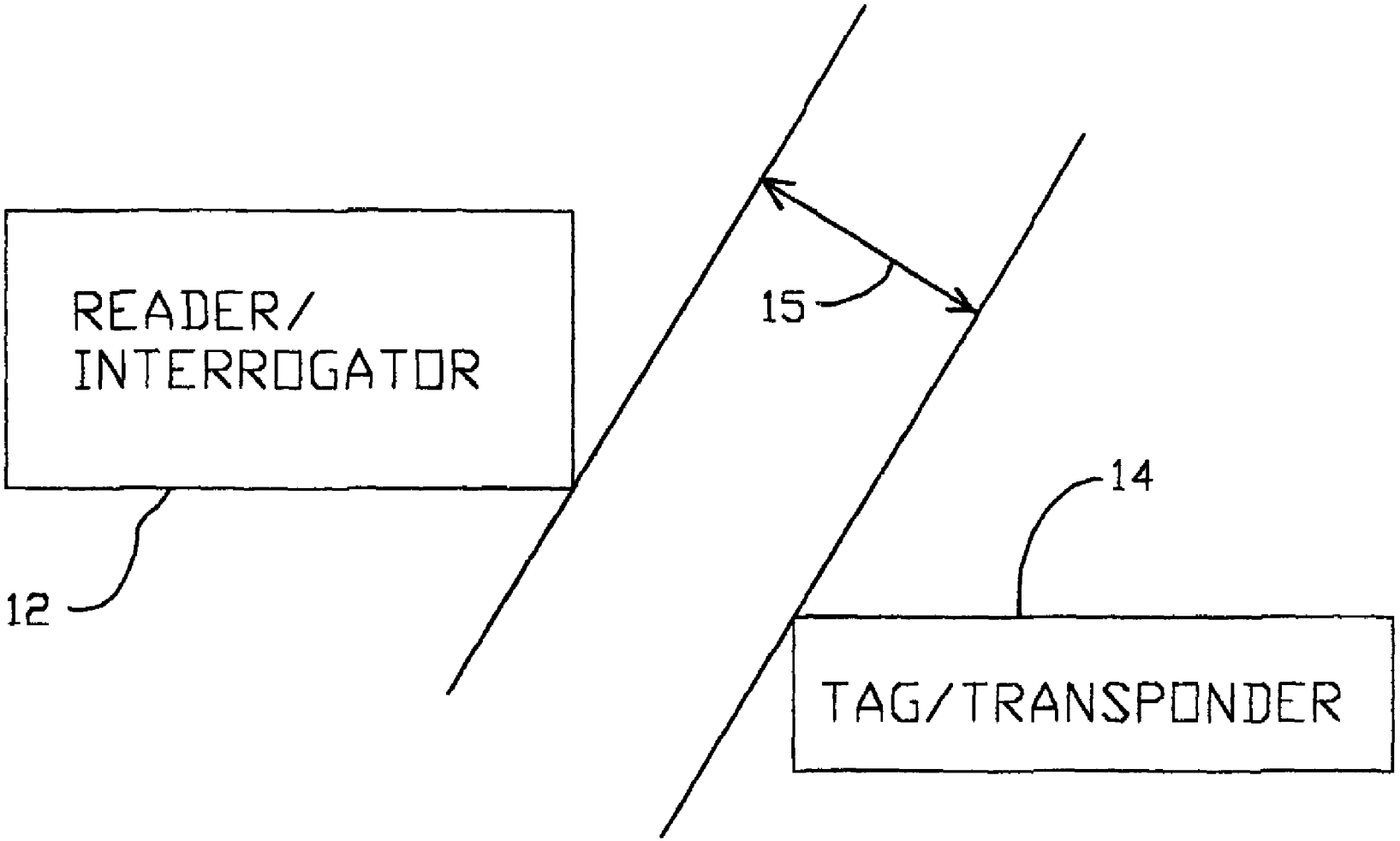
FIG. 1 is a block diagram of the major component portions of the remote temperature monitoring apparatus 90 of the invention.
Figure 2:
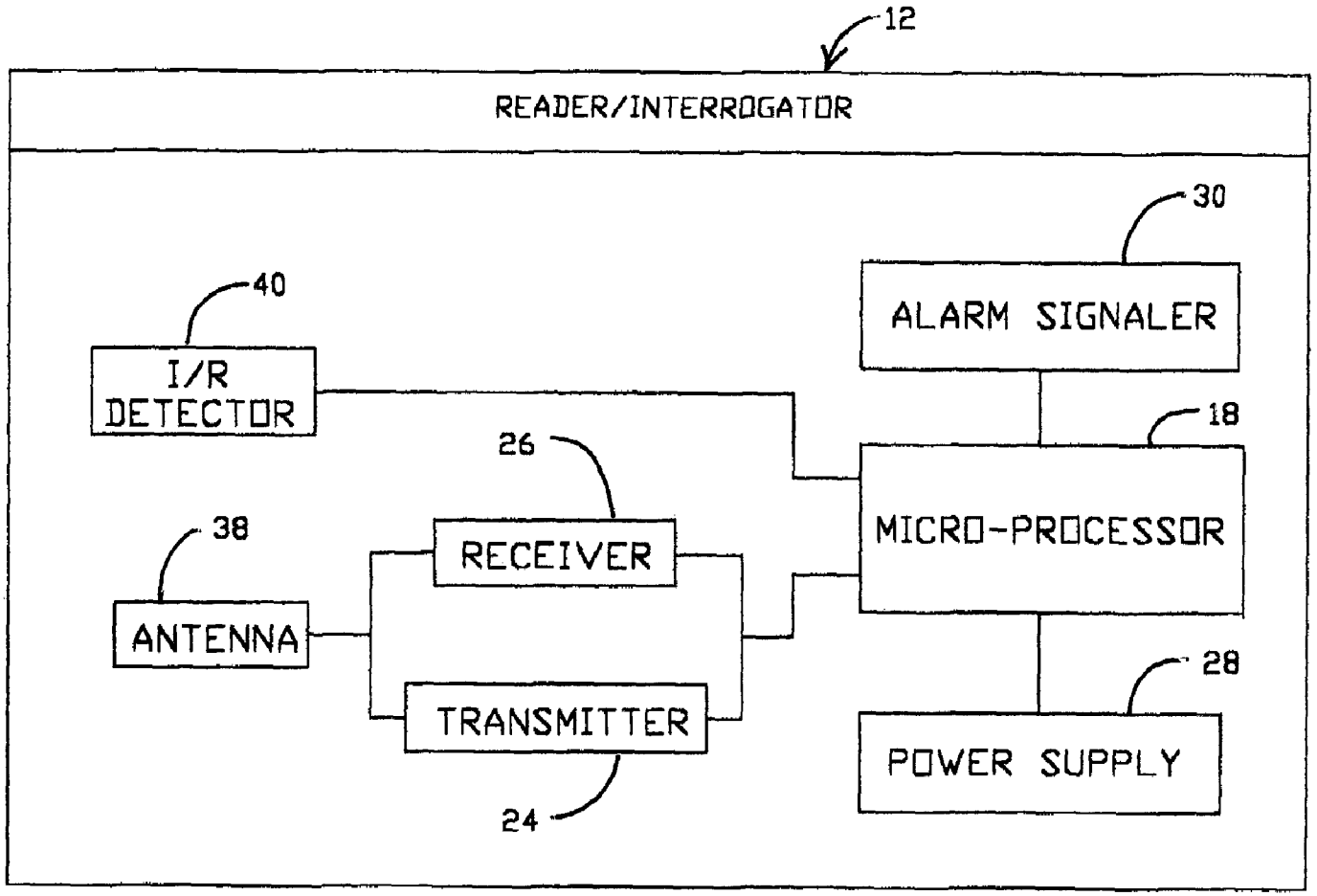
FIG. 2 is an electrical block diagram of a reader/interrogator unit.
Figure 3:
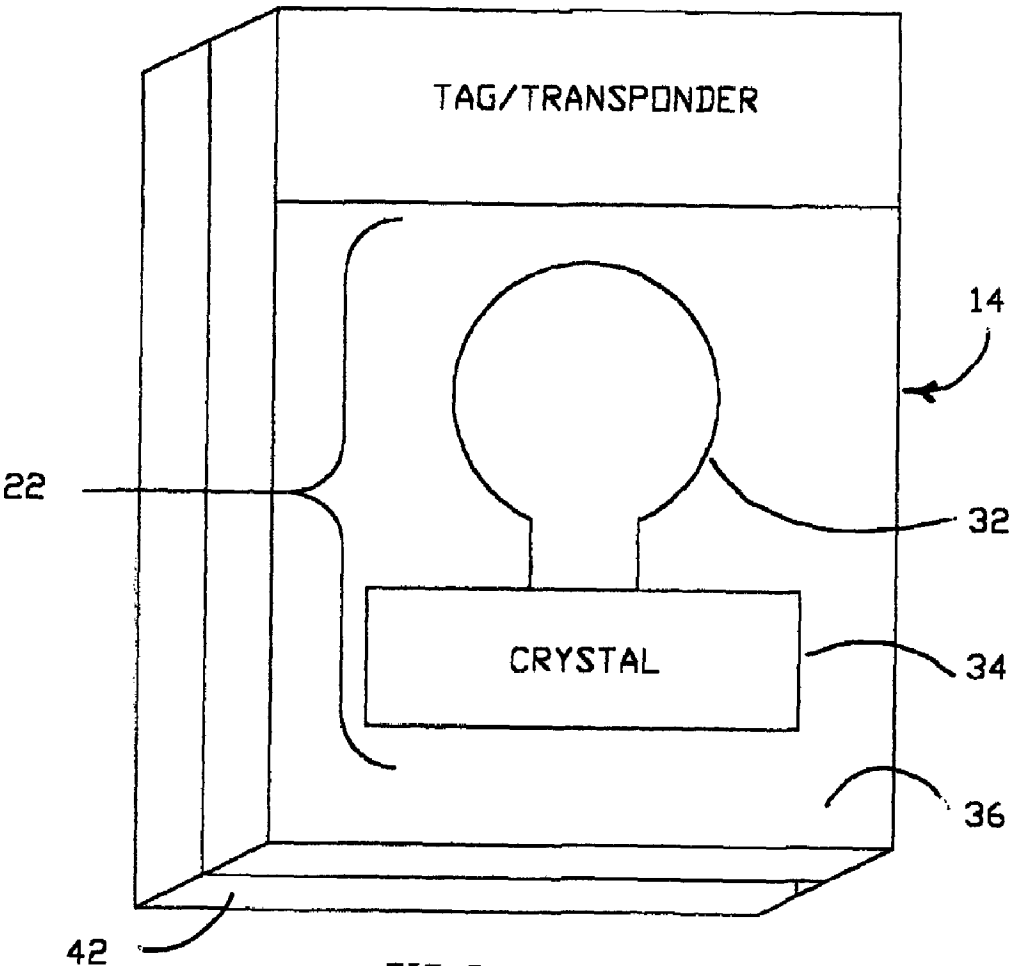
FIG. 3 is an electrical/mechanical block diagram of a tag/transponder unit.

As shown in FIGS. 1 and 2, the base-located energizing wave transmission/communication wave reception unit of the present invention can be a reader/interrogator 12. As shown in FIGS. 1 and 3, the remotely-located, energizing-wave-powered, temperature-dependent communication wave emission unit can be a tag/transponder 14. The reader/interrogator 12 and the tag/transponders 14 can communicate with one another by means of radio frequency waves (RF). Similarly, the reader/interrogator 12 can energize the tag/transponder 14 by means of radio frequency waves (RF). Plural tag/transponders 14 can be used for plural remote locations.

The reader/interrogator 12 of the remote temperature monitoring apparatus can be mounted at a suitable base location. The reader/interrogator 12 contains all of the necessary circuitry, antenna, power source, etc. to communicate with the tag/transponders 14. More specifically, as shown in FIG. 2, the reader/interrogator 12 includes an antenna 38, a transmitter 24, a receiver 26, a power supply 28, and an embedded microprocessor 18 that controls all of the functions necessary to read the remote tag/transponders 14, interpret the data received from the tag/transponders 14, and take the appropriate actions based on the data received from the tag/transponders 14. An alarm signaller 30 is controlled by the microprocessor 18.

For a reader/interrogator 12 used on a cooking stove to detect and warn of unsafe conditions on the range top during cooking, the reader/interrogator 12 can be approximately 6 inches by 8 inches in size and can be mounted in a suitable location such as the back of a range.

One or more of the tag/transponders 14 are located at remote locations. Each tag/transponder 14 contains all of the electronic circuitry necessary to communicate with the reader/interrogator 12 and to modify the means for communication or communication medium in a way that can be correlated with the temperature at the respective remote location.

For a tag/transponder 14 used on cooking vessels heated on a cooking stove, the tag/transponder 14 is mounted directly on a cooking vessel. Preferably, a tag/transponder 14 is about 2 inches in diameter, about 0.1 to 0.2 inches thick, and is flexible so that it will take the shape of the vessel on which it is mounted. A tag/transponder 14 is backed with an adhesive 42 that holds the tag/transponder 14 to the cooking vessel. The tag/transponder 14 is made of materials that can withstand repeated washing, both hand and machine. The tag/transponder 14 is able to withstand temperatures in excess of 400 degrees Fahrenheit and will not burn under any conditions. The tag/transponder 14 is made of materials that are sterile and will not harbor germs or any pathological agent. The tag/transponder 14 is made of ferromagnetic material that electrically isolates the tag/transponder 14 from metal surfaces. The tag/transponder 14 contains all of the electronic circuitry necessary to communicate with the reader/interrogator 12 and to modify the means for communication or communication medium in a way that can be correlated with the temperature of the cooking vessel.

The apparatus of the invention can employ various means to warn the cook that an alarm condition exists on the stove. One warning means employs an audible alarm, similar to a conventional smoke detector. In addition, a visible warning light can be provided. Still additionally, an audible recording of a human voice can be employed. Preferably, a light emitting diode (LED) can be employed to flash when the apparatus detects that the stove has been turned "on" and would continue to flash until the apparatus no longer detects any significant temperature. Such a flashing LED would indicate to the cook that the apparatus is working and is sensing the conditions on the stovetop. A low battery indication would also be signaled. Again, this probably would be much as a smoke detector, i.e. the horn would sound at a predetermined interval until the battery is changed.

Additional circuitry can be provided for an apparatus which carries out the function of reading the stovetop temperature when no tag/transponder 14 is present. This will allow the apparatus to detect the situation when the stove is left "on", and no cooking vessels are present. In this respect, a simple infrared (IR) detector 40 (shown in FIG. 2) can be mounted in the reader/interrogator 12 to handle this function. The IR detector 40 can be a simple single element detector. Accomplishing this function is relatively simple because it is only necessary to detect the presence of significant heat with no tag/transponder being present.

In one way of implementing the tag/transponder 14, as shown in FIG. 3, the tag/transponder 14 is composed of a base material upon which an antenna and a crystal are mounted. The antenna can be either an etched pattern on the substrate 36 or a discrete wire shaped to form the antenna 32 and then mounted on the substrate 36. A quantity of an adhesive 42 can located on the bottom of the substrate 36. The antenna 32 is electrically connected to the crystal 34. The combination antenna/crystal circuit 22 is designed to have a nominal resonant frequency at room temperature that matches the nominal frequency of the reader/interrogator 12 described above. The crystal design ("cut" in crystal jargon) is chosen so that the frequency versus temperature curve is optimal and is pre-programmed in the reader/interrogator 12 microprocessor.

Generally, quartz crystals can be cut in a wide variety of ways. Conventionally, a relatively large number of cuts provide crystals which exhibit a relatively low ratio of the range of resonant frequencies to the range of temperatures that the crystals normally experience. In other words, a large number of crystals are cut so that their respective resonant frequencies are relatively immune from temperature changes.

In contrast, with the present invention, a crystal cut is selected so that a crystal exhibits a relatively high ratio of the range of resonant frequencies to the range of temperatures that the crystal normally experience. In other words, with the invention, crystals are cut and selected so that their respective resonant frequencies are significantly affected by temperature changes they experience.

Figure 4:
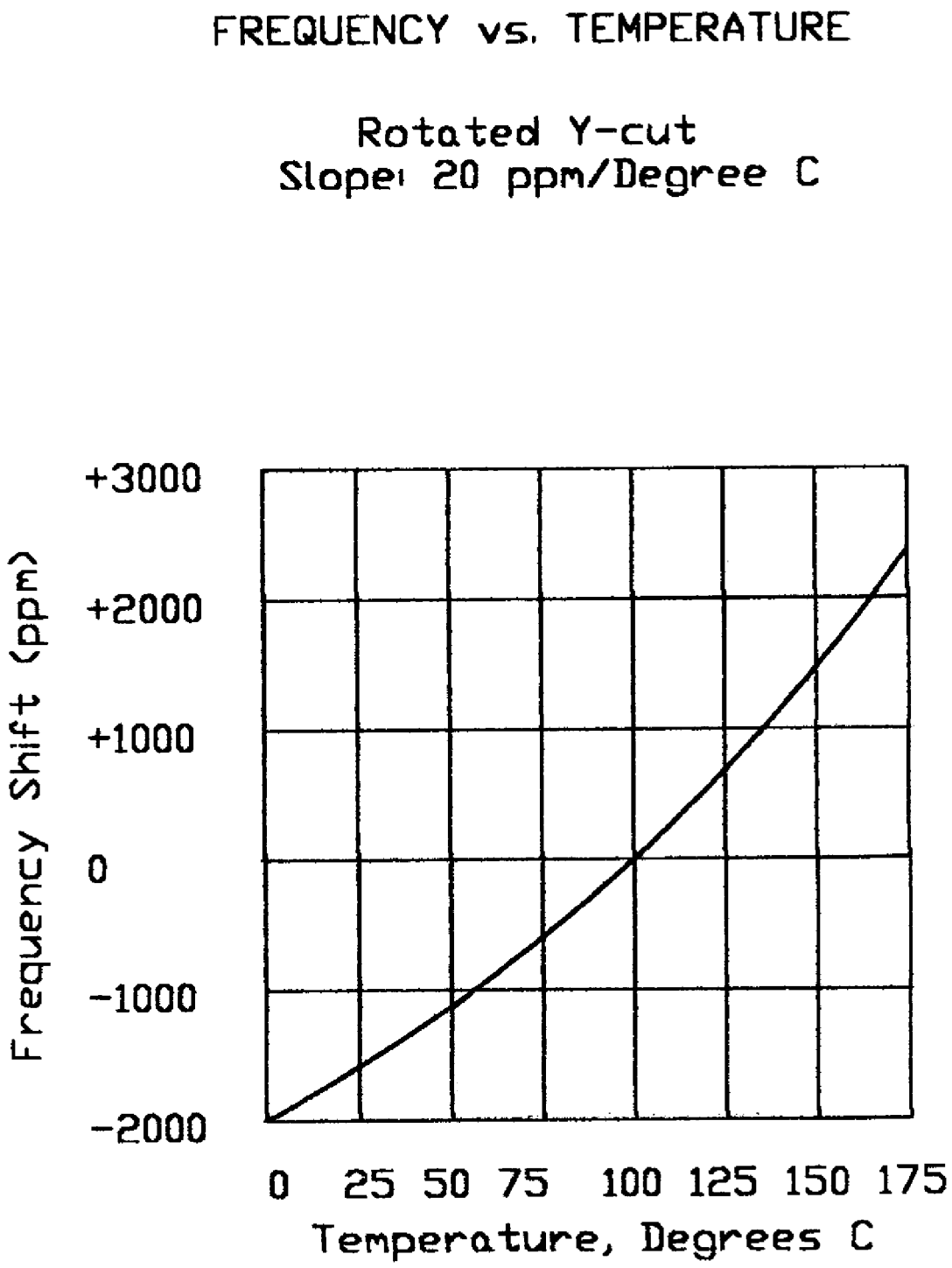
FIG. 4 is a curve showing crystal resonant frequency versus temperature of a temperature-dependent crystal used in a combination antenna/crystal circuit, wherein the crystal is a rotated Y-cut quartz crystal.

More specifically, for a temperature application ranging from 0 degrees Centigrade to 175 degrees Centigrade and beyond, for a quartz crystal, a suitable crystal "cut" can be a rotated Y-cut. The net result of the combination antenna/crystal is a tag/transponder 14 that has a RF resonance frequency that varies with the temperature of the tag/transponder 14. Since the variation of the resonant frequency characteristic of the crystal versus temperature is known, as indicated in a crystal resonant frequency versus temperature curve, such as shown in FIG. 4, it is a simple matter of sensing the resonant frequency of each tag/transponder 14. The temperature of this resonance point is then found from the crystal resonant frequency versus temperature curve of the crystal.

A practical tag/transponder 14 designed to the above criteria can have the following characteristics. The nominal RF frequency is of the crystal is 27.12 MHZ. This is an "ISM" frequency as defined by the FCC for unlicensed use for "industrial, medical, or scientific" purposes. The 27.12 MHZ ISM band has an allowable bandwidth of approximately 140,000 Hz.

Another practical tag/transponder 14 designed to the above criteria can have the following characteristics. The nominal RF frequency of the crystal is 13.56 MHZ. This is another "ISM" frequency and is allocated by the FCC for unlicensed use and is primarily used for RF identification (ID) applications such as baggage handling and theft detection devices. The 13.56 MHZ ISM band has an allowable bandwidth of approximately 7,000 Hz. The tag/transponder 14 of the invention can employ a 13.56 MHZ crystal.

As stated above, a 27.12 MHZ crystal can have a 140,000 HZ bandwidth, and the 13.56 MHZ crystal can have a 7,000 HZ bandwidth. The additional bandwidth for the 27.12 MHZ crystal gives a wider latitude of crystals to chose from. Generally, however, the specific frequency of the crystal is not a critical issue. Substantially any suitable frequency will operate in accordance with the principles of the present invention.

Generally, an appropriate crystal exhibits an almost linear crystal resonant frequency versus temperature curve with about 2 parts per million-frequency deviation per degree Centigrade. For the 13.56 MHZ frequency, this means that the nominal frequency would change from 13.560 MHZ to 13.564 MHZ over the desired temperature range. The reader/interrogator 12 is designed to scan the RF frequency emitted from the tag/transponder 14 and correlate the emitted frequency to the temperature of the tag/transponder 14.

With the invention, preferably, the material which has a temperature-dependent communication wave emission characteristic has a range of temperature-dependent resonant frequencies corresponding to a range of monitored temperatures. In this respect, the base-located energizing wave transmission/communication wave reception unit transits a probing energizing wave which has a probing frequency. The remotely-located, energizing-wave-powered, temperature-dependent communication wave emission unit receives the probing energizing wave which has the probing frequency, and, when a temperature-dependent resonant frequency of the material which has a temperature-dependent communication wave emission characteristic substantially matches the probing frequency, the material which has a temperature-dependent communication wave emission characteristic emits a temperature-dependent resonant frequency which corresponds to a specific monitored temperature in the range of monitored temperatures.

The base-located energizing wave transmission/communication wave reception unit receives the temperature-dependent resonant frequency emitted from the remotely-located, energizing-wave-powered, temperature-dependent communication wave emission unit, which corresponds to the specific monitored temperature, and compares the specific monitored temperature to the predetermined alarm temperature.

More preferably, the base-located energizing wave transmission/communication wave reception unit transmits a series of probing energizing waves which have a series of probing frequencies. The duration of time for probing energizing waves and the time interval between each of the probing energizing waves can be selected as desired. The probing energizing waves can be in a form of wave pulses. In this respect, the remotely-located, energizing-wave-powered, temperature-dependent communication wave emission unit receives the series of probing energizing waves which have the series of probing frequencies, and, when a temperature-dependent resonant frequency of the material which has a temperature-dependent communication wave emission characteristic substantially matches a specific probing frequency of the series of probing frequencies, the material which has a temperature-dependent communication wave emission characteristic emits a temperature-dependent resonant frequency which corresponds to a specific monitored temperature in the range of monitored temperatures.

The base-located energizing wave transmission/communication wave reception unit receives the temperature-dependent resonant frequency emitted from the remotely-located, energizing-wave-powered, temperature-dependent communication wave emission unit, wherein the temperature-dependent resonant frequency corresponds to the specific monitored temperature. The base-located energizing wave transmission/communication wave reception unit can consult a calibration table such as one that is programmed into the microprocessor and which stores correspondences between received resonant frequencies and known measured temperatures. Once a specific monitored temperature is determined from the calibration table, the base-located energizing wave transmission/communication wave reception unit compares the specific monitored temperature to the predetermined alarm temperature to determine whether the alarm temperature has been reached and whether an alarm should be actuated.

The probing frequencies in the series of probing frequencies are separated from one another by a probing frequency interval, and the probing frequency interval is proportional to the ratio of the range of resonant frequencies to the range of monitored temperatures of the material has a temperature-dependent communication wave emission characteristic. That is, for a relatively large ratio of the range of resonant frequencies to the range of monitored temperatures of the material which has a temperature-dependent communication wave emission characteristic, the probing frequency interval is relatively large. Conversely, for a relatively small ratio of the range of resonant frequencies to the range of monitored temperatures of the material which has a temperature-dependent communication wave emission characteristic, the probing frequency interval is relatively small.

More specifically, for a monitored temperature range from approximately 25 degrees Centigrade to 225 degrees Centigrade, the full temperature range includes 200 degrees Centigrade.

The crystals having a nominal frequency of 13.56 MHz and a nominal frequency of 27.12 MHz are considered again.

For a crystal having a nominal frequency of 13.56 MHz, such a crystal is permitted by the FCC to have a bandwidth of 7,000 Hz. Therefore, with this crystal frequency, the ratio of the range of resonant frequencies to the range of monitored temperatures of the material which has a temperature-dependent communication wave emission characteristic is 7,000 Hz/200 degrees Centigrade which equals 35 Hz/degree.

In contrast, for a crystal which has a nominal frequency of 27.12 MHz, such a crystal is permitted by the FCC to have a bandwidth of 140,000 Hz. Therefore, with this crystal, the ratio of the range of resonant frequencies to the range of monitored temperatures of the material which has a temperature-dependent communication wave emission characteristic is 140,000 Hz/200 degrees Centigrade which equals 700 Hz/degree.

Clearly, the probing frequency interval of the 27.12 MHz crystal can be 20 times greater than the probing frequency interval for the 13.56 MHz crystal. The greater the probing frequency interval, the greater precision in probing frequencies and the greater precision is measuring frequencies is possible. That is, the greater the probing frequency interval, the greater precision in measuring the monitored temperature is possible.

The comparison of the specific monitored temperature to the predetermined alarm temperature can be carried out in a number of ways. For example, the microprocessor 18 can either contain or consult a table in which temperature-dependent resonant frequencies are correlated to specific monitored temperatures in the range of monitored temperatures. For a specific measurement, a specific monitored temperature is compared to the predetermined alarm temperature. If the specific monitored temperature is equal to or exceeds the predetermined alarm temperature, then the alarm is activated.

In the situation where multiple tag/transponders 14 are in use at the same time in association with one reader/interrogator 12, multiple respective tag/transponders 14 can respond simultaneously, and the reader/interrogator 12 may not be able to tell which tag/transponder 14 responded to which RF frequency. However, if the respective remote locations for the respective tag/transponders 14 are relatively close to one another, such as multiple cooking vessels on a common stove top, this indefinite identification of a specific tag/transponder 14 does not matter, since one is interested only in any tag/transponder 14 exceeding a certain frequency thus indicating an alarm condition. It is not significant as to which tag/transponder 14 caused the alarm. The only importance is knowing the fact that one or more tag/transponders 14 have exceeded the alarm temperature.

There is a wide range of environments in which a remote temperature monitoring apparatus of the invention can be employed for monitoring the temperature of a remotely-located energizing wave receiver/temperature sensing/temperature-dependent communication wave emission unit (e. g. a tag/transponder 14) at remote location, by a base-located energizing wave transmission/communication wave reception unit (e. g. a reader/interrogator 12) at a base location, and for causing the base-located energizing wave transmission/communication wave reception unit to provide an alarm signal if the monitored temperature is outside of an acceptable range. The base location is separated from the remote location by a separation distance 15. With reference to FIG. 1, a number of such application environments are set forth below.

In the environment of a heating device, a reader/interrogator 12 can be located at a suitable base location, such as a control panel of the heating device, and a tag/transponder 14 is located at a remote location, such as on a vessel being heated by the heating device and for monitoring the temperature of the vessel being heated by the heating device and for causing the reader/interrogator 12 to emit an alarm signal if the monitored temperature of the heated vessel is outside of an acceptable range.

In a medical environment, the reader/interrogator 12 can be located at a suitable base location, such as outside a patient, and the tag/transponder 14 is located at a remote location, such as inside a patient, wherein the tag/transponder 14 is swallowed by the patient in a "pill" form for monitoring the core temperature of the patient and for causing the reader/interrogator 12 to emit an alarm signal if the core temperature of the patient is outside of an acceptable range. The "pill" form does not include an adhesive on the outside of the "pill" form and would be of an appropriate shape.

Also, in a medical environment, the reader/interrogator 12 can be located at a suitable base location, such as outside a patient in an operating room, and the tag/transponder 14 is located at a remote location, such as inside a patient undergoing an operation for monitoring the temperature of the lavage fluids used in the operation and pooled in a body cavity and for causing the reader/interrogator 12 to emit an alarm signal if the monitored temperature of the lavage fluids used in the operation is outside of an acceptable range.

In the environment of a cooling device, such as a "slush" bag containing a mixture of water and ice, that is used for preserving organs to be transplanted, the reader/interrogator 12 can be located at a location outside the "slush" bag, and the tag/transponder 14 is located at a remote location, such as inside the "slush" bag, for monitoring the temperature of the "slush" and preserved organs, and for causing the reader/interrogator 12 to emit an alarm signal if the monitored temperature of the "slush" and preserved organs is outside of an acceptable range.

In an automotive environment, the reader/interrogator 12 can be located at a suitable base location, such as in a passenger compartment of a vehicle, and the tag/transponder 14 is located at a remote location, such as on a brake component for monitoring the temperature of the brake component and for causing the reader/interrogator 12 to emit an alarm signal if the monitored temperature of the brake component is outside of an acceptable range.

In an automotive environment, the reader/interrogator 12 can be located at a suitable base location, such as in a passenger compartment of a vehicle, and the tag/transponder 14 is located at a remote location, such as on a catalytic converter for monitoring the temperature of the catalytic converter and for causing the reader/interrogator 12 to emit an alarm signal if the monitored temperature of the catalytic component is outside of an acceptable range.

In an aircraft environment, the reader/interrogator 12 can be located at a suitable base location, such as inside an airplane cockpit, and the tag/transponder 14 is located at a remote location, such as on an engine tailpipe for monitoring the temperature of the engine tailpipe and for causing the reader/interrogator 12 to emit an alarm signal if the monitored temperature of the engine tailpipe is outside of an acceptable range.

In accordance with another aspect of the invention, a method is provided for monitoring temperature of a remote location at a base location, comprising the following steps. Base-emitted energizing waves are emitted from a transmitter at the base location. The base-emitted energizing waves are received at the remote location, whereby the base-emitted energizing waves energize a temperature-dependent transmitter at the remote location. Remote-location-emitted, temperature-dependent communication waves are emitted from the temperature-dependent transmitter at the remote location, wherein the remote-location-emitted, temperature-dependent communication waves represent a temperature measurement at the remote location. The temperature-dependent transmitter at the remote location includes a quantity of material having a temperature-dependent communication wave emission characteristic. The remote-location-emitted, temperature-dependent communication waves are received at the base location. The temperature measurement at the remote location is compared with a predetermined alarm temperature. An alarm signal is provided if the temperature measurement at the remote location is equal to or greater than the predetermined alarm temperature.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a remote temperature monitoring apparatus that is low in cost, relatively simple in design and operation, and which may advantageously be used to detect, warn, and if necessary correct dangerous overheating situations. With the invention, a remote temperature monitoring apparatus provides a wireless communication link between a base location and a remote location. With the invention, a remote temperature monitoring apparatus is provided which in the environment of a heating device, monitors at the heating device, the temperature of a remotely-located heated vessel, and provides an alarm signal if the monitored temperature is outside of an acceptable range. With the invention, a remote temperature monitoring apparatus is provided which in the environment of a cooking stove, monitors, at the cooking stove, the temperature of a cooking vessel heated on the stove, and provides an alarm signal if the monitored temperature of the cooking vessel is outside of an acceptable range. With the invention, a remote temperature monitoring apparatus is provided which in a medical environment, monitors, at a base location, such as outside a patient, the temperature at a remote location, such as inside a patient, and provides an alarm signal if the monitored temperature is outside of an acceptable range. With the invention, a remote temperature monitoring apparatus is provided which in a medical environment, provides that the location inside the patient can be monitored by a "pill" type device that is swallowed by the patient for monitoring the core temperature of the patient and for causing an alarm signal, at a base location, if the core temperature of the patient is outside of an acceptable range.

With the invention, a remote temperature monitoring apparatus is provided which in a medical environment, monitors, at a base location, such as outside a patient in an operating room, the temperature at a remote location, such as inside a patient undergoing an operation for monitoring the temperature of the lavage fluids used in the operation and pooled in a body cavity and for causing an alarm signal to be emitted if the monitored temperature of the lavage fluids used in the operation is outside of an acceptable range. With the invention, a remote temperature monitoring apparatus is provided which in the environment of a cooling device, such as a "slush" bag containing a mixture of water and ice, that is used for preserving organs to be transplanted, can have a portion located at a base location outside the "slush" bag, and can have another portion located at a remote location, such as inside the "slush" bag, for monitoring the temperature of the "slush" and preserved organs, and for causing an alarm signal to be emitted if the monitored temperature of the "slush" and preserved organs is outside of an acceptable range. With the invention, a remote temperature monitoring apparatus is provided which in an automotive environment, can have a portion located at a base location, such as in a passenger compartment of a vehicle, and can have another portion located at a remote location, such as on a brake component, for monitoring the temperature of the brake component and for causing the an alarm signal to be emitted if the monitored temperature of the brake component is outside of an acceptable range. With the invention, a remote temperature monitoring apparatus is provided which in an aircraft environment, can have a portion located at a base location, such as inside an airplane cockpit, and can have another portion located at a remote location, such as on an engine tailpipe for monitoring the temperature of the engine tailpipe and for causing an alarm signal to be emitted if the monitored temperature of the engine tailpipe is outside of an acceptable range. With the invention, a remote temperature monitoring apparatus is provided which does not employ battery-powered transceiver modules placed on cooking implements. With the invention, a remote temperature monitoring apparatus is provided which includes, in general, a material having a temperature-dependent communication wave emission characteristic or, more specifically, a material having a temperature-dependent, radio frequency electromagnetic wave emission frequency characteristic.

With respect to the above description, it should be realized that optimum relationships for the parts of the invention, including variations in size, form, function, manner of operation, assembly, and use are deemed readily apparent and obvious to those skilled in the art; and therefore, all relationships equivalent to those illustrated in the drawings and described in the specification are intended to be encompassed by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A remote temperature monitoring apparatus, comprising:

a base-located energizing wave transmission/communication wave reception unit located at a base location, that transmits an energizing wave and that receives temperature-dependent communication wave emissions, and a remotely-located, energizing-wave-powered, temperature-dependent communication wave emission unit, located at a remote location from the base location, for monitoring temperature at the remote location and for transmitting a temperature-dependent communication wave emission, wherein said remotely-located, energizing-wave-powered, temperature-dependent communication wave emission unit includes a crystal material having a temperature-dependent communication wave emission characteristic, and wherein said crystal material is directly connected to an antenna, wherein said material having a temperature-dependent communication wave emission characteristic is powered by said energizing wave from said base-located energizing wave transmission/communication wave reception unit, and wherein said temperature-dependent communication wave emission is received by said base-located energizing wave transmission/communication wave reception unit which provides an alarm signal when the monitored temperature at the remote location is equal to or is beyond a predetermined alarm temperature.

2. The apparatus of claim 1 wherein said base-located energizing wave transmission/communication wave reception unit provides said alarm signal at said base location.

3. The apparatus of claim 1 wherein:

said crystal material having a temperature-dependent communication wave emission characteristic has a range of temperature-dependent resonant frequencies corresponding to a range of monitored temperatures, said base-located energizing wave transmission/communication wave reception unit transmits a probing energizing wave having a probing frequency, said remotely-located, energizing-wave-powered, temperature-dependent communication wave emission unit receives said probing energizing wave having said probing frequency, and, when a temperature-dependent resonant frequency of said material having a temperature-dependent communication wave emission characteristic substantially matches said probing frequency, said material having a temperature-dependent communication wave emission characteristic emits a temperature-dependent resonant frequency which corresponds to a specific monitored temperature in said range of monitored temperatures, and said base-located energizing wave transmission/communication wave reception unit receives said temperature-dependent resonant frequency emitted from said remotely-located, energizing-wave-powered, temperature-dependent communication wave emission unit, which corresponds to said specific monitored temperature, and compares said specific monitored temperature to said predetermined alarm temperature to determine whether said specific monitored temperature is equal to or is beyond the predetermined alarm temperature.

4. The apparatus of claim 3 wherein:

said base-located energizing wave transmission/communication wave reception unit transmits a series of probing energizing waves having a series of probing frequencies, said remotely-located, energizing-wave-powered, temperature-dependent communication wave emission unit receives said series of probing energizing waves having said series of probing frequencies, and, when a temperature-dependent resonant frequency of said crystal material having a temperature-dependent communication wave emission characteristic substantially matches a specific probing frequency of said series of probing frequencies, said crystal material having a temperature-dependent communication wave emission characteristic emits a temperature-dependent resonant frequency which corresponds to a specific monitored temperature in said range of monitored temperatures, and said base-located energizing wave transmission/communication wave reception unit receives said temperature-dependent resonant frequency emitted from said remotely-located, energizing-wave-powered, temperature-dependent communication wave emission unit, which corresponds to said specific monitored temperature, and compares said specific monitored temperature to said predetermined alarm temperature to determine whether said specific monitored temperature is equal to or is beyond the predetermined alarm temperature.

5. The apparatus of claim 4 wherein:

probing frequencies in said series of probing frequencies are separated from one another by a probing frequency interval, and said probing frequency interval is proportional to the ratio of the range of resonant frequencies to the range of monitored temperatures of said material having a temperature-dependent communication wave emission characteristic.

6. The apparatus of claim 1 wherein:

said remotely-located, energizing-wave-powered, temperature-dependent communication wave emission unit is located at a vessel being heated by a heating device and is used for monitoring the temperature of the vessel being heated, and said base-located energizing wave transmission/communication wave reception unit is located at a location away from the vessel being heated and provides an alarm signal when the monitored temperature of the vessel being heated is equal to or is beyond the predetermined alarm temperature.

7. The apparatus of claim 1 wherein said remotely-located, energizing-wave-powered, temperature-dependent communication wave emission unit is in a pill-like form and is used for monitoring the core temperature of the patient and provides an alarm signal when the monitored core temperature of the patient is equal to or is beyond the predetermined alarm temperature.

8. The apparatus of claim 1 wherein:

said remotely-located, energizing-wave-powered, temperature-dependent communication wave emission unit is located inside a patient undergoing an operation and is used for monitoring the temperature of lavage fluids used in the operation and pooled in a body cavity, and said base-located energizing wave transmission/communication wave reception unit is located outside the patient and provides an alarm signal when the monitored temperature of the lavage fluids used in the operation and pooled in a body cavity is equal to or is beyond the predetermined alarm temperature.

9. The apparatus of claim 1 wherein:

said remotely-located, energizing-wave-powered, temperature-dependent communication wave emission unit is located inside a cooling device and is used for monitoring the temperature inside the cooling device, and said base-located energizing wave transmission/communication wave reception unit is located outside the cooling device and provides an alarm signal when the monitored temperature inside the cooling device is equal to or is beyond the predetermined alarm temperature.

10. The apparatus of claim 9 wherein the cooling device is a slush bag for holding preserved organs.

11. The apparatus of claim 1 wherein:

said remotely-located, energizing-wave-powered, temperature-dependent communication wave emission unit is located at an automotive component outside a passenger compartment and is used for monitoring the temperature of the automotive component, and said base-located energizing wave transmission/communication wave reception unit is located inside the passenger compartment and provides an alarm signal when the monitored temperature of the automotive component outside the passenger compartment is equal to or is beyond the predetermined alarm temperature.

12. The apparatus of claim 1 wherein:

said remotely-located, energizing-wave-powered, temperature-dependent communication wave emission unit is located at a brake component, and said base-located energizing wave transmission/communication wave reception unit provides an alarm signal when the monitored temperature of the brake component is equal to or is beyond the predetermined alarm temperature.

13. The apparatus of claim 1 wherein:

said remotely-located, energizing-wave-powered, temperature-dependent communication wave emission unit is located at a catalytic converter, and said base-located energizing wave transmission/communication wave reception unit provides an alarm signal when the monitored temperature of the catalytic converter is equal to or is beyond the predetermined alarm temperature.

14. The apparatus of claim 1 wherein:

said remotely-located, energizing-wave-powered, temperature-dependent communication wave emission unit is located at an aircraft component outside a cockpit and is used for monitoring the temperature of the aircraft component, and said base-located energizing wave transmission/communication wave reception unit is located inside the cockpit and provides an alarm signal when the monitored temperature of the aircraft component outside the cockpit is equal to or is beyond the predetermined alarm temperature.

15. The apparatus of claim 1 wherein:

said remotely-located, energizing-wave-powered, temperature-dependent communication wave emission unit is located at an engine tailpipe, and said base-located energizing wave transmission/communication wave reception unit provides an alarm signal when the monitored temperature of the an engine tailpipe is equal to or is beyond the predetermined alarm temperature.

16. The apparatus of claim 1 wherein said energizing wave and said temperature-dependent communication wave emission are electromagnetic waves.

17. The apparatus of claim 1 wherein said energizing wave and said temperature-dependent communication wave emission are radio frequency electromagnetic waves.

18. The apparatus of claim 1 wherein said remotely-located, energizing-wave-powered, temperature-dependent communication wave emission unit includes a resonating wave emitter.

19. The apparatus of claim 1 wherein:

base-located energizing wave transmission/communication wave reception unit includes a reader/interrogator, and said remotely-located, energizing-wave-powered, temperature-dependent communication wave emission unit includes a tag/transponder which includes said crystal material having a temperature-dependent communication wave emission characteristic.

20. The apparatus of claim 19 wherein:

said reader/interrogator includes a transmitter portion and a receiver portion which respectively transmits and receives communication wave emissions in a frequency range having a predetermined nominal wave frequency, and said material having a temperature-dependent communication wave emission characteristic in said tag/transponder includes a receiver/transmitter which respectively receives and transmits communication wave emissions in a frequency range including said predetermined nominal wave frequency, wherein said communication wave emissions transmitted by said tag/transponder vary in accordance with the temperature of said material having a temperature-dependent communication wave emission characteristic.

21. The apparatus of claim 19 wherein:

said reader/interrogator includes a transmitter portion and a receiver portion which respectively transmits and receives radio frequency electromagnetic waves in a frequency range having a predetermined nominal radio frequency, and said crystal material having a temperature-dependent communication wave emission characteristic in said tag/transponder includes a crystal-based receiver/transmitter which respectively receives and transmits radio frequency electromagnetic waves in a frequency range including said predetermined nominal radio frequency, wherein said radio frequency electromagnetic waves transmitted by said tag/transponder vary in accordance with the temperature of said crystal-based receiver/transmitter.

22. The apparatus of claim 19 wherein:

said reader/interrogator includes a transmitter portion and a receiver portion which respectively transmits and receives radio frequency electromagnetic waves in a frequency range having a nominal radio frequency of 27.12 MHz, said crystal material having a temperature-dependent communication wave emission characteristic in said tag/transponder includes a crystal-based receiver/transmitter which respectively receives and transmits radio frequency electromagnetic waves in a frequency range having a nominal radio frequency of 27.12 MHz, wherein said radio frequency electromagnetic waves transmitted by said tag/transponder vary in accordance with the temperature of said crystal-based receiver/transmitter.

23. The apparatus of claim 22 wherein said crystal-based receiver/transmitter includes a quartz crystal.

24. The apparatus of claim 22 wherein said crystal-based receiver/transmitter includes an antenna connected to a quartz crystal.

25. The apparatus of claim 1 wherein:

said reader/interrogator includes a transmitter portion and a receiver portion which respectively transmits and receives radio frequency electromagnetic waves in a frequency range having a nominal radio frequency of 13.56 MHz, and said crystal material having a temperature-dependent communication wave emission characteristic in said tag/transponder includes a crystal-based receiver/transmitter which respectively receives and transmits radio frequency electromagnetic waves in a frequency range having a nominal radio frequency of 13.56 MHz, wherein said radio frequency electromagnetic waves transmitted by said tag/transponder vary in accordance with the temperature of said crystal-based receiver/transmitter.

26. The apparatus of claim 25 wherein said crystal-based receiver/transmitter includes a quartz crystal.

27. The apparatus of claim 25 wherein said crystal-based receiver/transmitter includes an antenna connected to a quartz crystal.

28. A safety apparatus for a heated object, comprising:

a reader/interrogator, remote from the heated object, which emits and receives radio frequency electromagnetic waves in a frequency range having a predetermined nominal radio frequency, a tag/transponder attached to the heated object, wherein said tag/transponder includes a radio frequency electromagnetic wave emitter which includes a crystal material having a temperature-dependent radio frequency electromagnetic wave emission characteristic in a frequency range having said predetermined nominal radio frequency, wherein said crystal material is directly connected to an antenna, wherein said tag/transponder receives radio frequency electromagnetic waves from said reader/interrogator and emits temperature-dependent radio frequency electromagnetic waves from said temperature-dependent radio frequency electromagnetic wave emitter, wherein said temperature-dependent radio frequency electromagnetic waves are indicative of the temperature of the heated object, and wherein said temperature-dependent radio frequency electromagnetic waves are received by said reader/interrogator, and an alarm assembly, controlled by said reader/interrogator, for providing an alarm signal when said reader/interrogator receives temperature-dependent radio frequency electromagnetic waves from said tag/transponder which indicate that a predetermined temperature has been reached by the heated object.

29. The apparatus of claim 28 wherein:

the heated object is a cooking vessel, and said reader/interrogator is located on a cook stove.

30. A safety apparatus for a cook stove, comprising:

a reader/interrogator which emits and receives communication waves, a tag/transponder attached to a cooking vessel on the cook stove, wherein said tag/transponder includes a temperature-dependent communication wave emitter which includes a crystal material having a temperature-dependent communication wave emission characteristic, wherein said crystal material is directly connected to an antenna, wherein said tag/transponder receives communication waves from said reader/interrogator and emits temperature-dependent communication waves from said temperature-dependent communication wave emitter, wherein said temperature-dependent communication waves are indicative of the temperature of the cooking vessel, and wherein said temperature-dependent communication waves are received by said reader/interrogator, and an alarm assembly, controlled by said reader/interrogator, for providing an alarm signal when said reader/interrogator receives temperature-dependent communication waves from said tag/transponder which indicate that a predetermined temperature has been reached by the cooking vessel.

31. A method for monitoring temperature of a remote location at a base location, comprising the steps of:

emitting base-emitted energizing waves from a transmitter at the base location, receiving the base-emitted energizing waves at the remote location, whereby the base-emitted energizing waves energize a temperature-dependent transmitter at the remote location, wherein the temperature-dependent transmitter at the remote location includes a quantity of crystal material having a temperature-dependent communication wave emission characteristic, emitting remote-location-emitted, temperature-dependent communication waves from the temperature-dependent transmitter at the remote location, wherein the remote-location-emitted, temperature-dependent communication waves represent a temperature measurement at the remote location, based upon the temperature of the quantity of crystal material having a temperature-dependent communication wave emission characteristic, receiving the remote-location-emitted, temperature-dependent communication waves at the base location, comparing the temperature measurement at the remote location with a predetermined alarm temperature, and providing an alarm signal if the temperature measurement at the remote location is equal to or greater than the predetermined alarm temperature.

* * * * *